US007312755B2

(12) United States Patent
Ko et al.

(10) Patent No.: US 7,312,755 B2
(45) Date of Patent: Dec. 25, 2007

(54) INTERNAL ANTENNA OF WIRELESS COMMUNICATION TERMINAL

(75) Inventors: Young Joon Ko, Seoul (KR); Hong Teuk Kim, Yungin-si (KR)

(73) Assignee: LG Electronics Inc., Seoul (KR)

( * ) Notice: Subject to any disclaimer, the term of this patent is extended or adjusted under 35 U.S.C. 154(b) by 115 days.

(21) Appl. No.: 11/172,970

(22) Filed: Jul. 5, 2005

(65) Prior Publication Data

US 2006/0017629 A1 Jan. 26, 2006

(30) Foreign Application Priority Data

Jul. 6, 2004 (KR) ..... 10-2004-0052243

(51) Int. Cl.
*H01Q 1/24* (2006.01)

(52) U.S. Cl. ..... 343/702

(58) Field of Classification Search ..... 343/700 MS, 343/702, 846, 848, 824, 825
See application file for complete search history.

(56) References Cited

U.S. PATENT DOCUMENTS

| | | | | |
|---|---|---|---|---|
| 2,978,703 | A | 4/1961 | Kuecken | 343/803 |
| 4,516,127 | A | 5/1985 | Siwiak | 343/702 |
| 5,896,109 | A * | 4/1999 | Hachiga et al. | 343/702 |
| 5,959,825 | A | 9/1999 | Harcombe | 361/154 |
| 6,624,795 | B2 * | 9/2003 | Boyle | 343/895 |
| 7,136,022 | B2 * | 11/2006 | Sato et al. | 343/702 |
| 2004/0169606 | A1 * | 9/2004 | Sato et al. | 343/702 |
| 2004/0183727 | A1 | 9/2004 | Choi | 343/700 |
| 2004/0227665 | A1 | 11/2004 | Tai et al. | 343/700 |

FOREIGN PATENT DOCUMENTS

| | | |
|---|---|---|
| EP | 1 555 715 A1 | 7/2005 |
| JP | 08-204431 | 8/1996 |
| KR | 10-2004-0074257 A | 8/2004 |

* cited by examiner

*Primary Examiner*—Hoanganh Le
(74) *Attorney, Agent, or Firm*—Ked & Associates, LLP

(57) ABSTRACT

An internal antenna of a wireless communication terminal, in which internal style folded monopole antenna is installed, is provided. The internal antenna of a wireless communication terminal includes a folded monopole antenna. The folded monopole antenna includes two folded radiation planes having a quarter wavelength, and reactances loaded to predetermined positions of the two radiation planes. Therefore, a space for installing the antenna in the terminal is minimized, and due to the no directional characteristics, the internal antenna can be applied to a wireless communication system of dual bandwidths.

19 Claims, 10 Drawing Sheets

INTERNAL ANTENNA OF WIRELESS COMMUNICATION TERMINAL

BACKGROUND OF THE INVENTION

1. Field of the Invention

The present invention relates to a wireless communication, and more particularly, to an internal antenna of a wireless communication terminal in which internal style folded monopole antenna is installed.

2. Description of the Related Art

As wireless communication technologies are developed, communication terminals using handsets, wireless personal digital assistants (PDA), and wireless LAN are developed, and antennas employed in the respective terminals are main parts to give influence to the wireless communication performance of the communication terminals.

An external dipole antenna and a helical antenna are widely used as conventional antennas, employed in conventional wireless communication terminals. However, the external antenna has shortcomings such that the characteristics of the external antenna may be deformed by a user, the external antenna may give bad influence to design the wireless communication terminals, and since the external antenna is mounted to the outside of the wireless communication terminals, the wireless communication terminal cannot have aesthetic pleasing appearance.

In order to overcome the shortcomings, internal antennas are inevitable. For example, internal antennas for wireless LAN are employed in laptop computers, smart displays, Internet refrigerators, or the like having weak interference in a space and weak influence from ground of adjacent circuits and a case of the wireless communication terminals. However, since portable communication terminals such as a handset, a wireless personal digital assistant, or the like, has a very small space, it is difficult to apply the internal antennas to the portable communication terminals.

What has been employed in the handset is a planar inverted F-antenna (PIFA), and the wireless personal digital assistants are employing a ceramic chip antenna and the planar inverted F-antenna.

However, since the planar inverted F-antenna has narrow bandwidth, radiation efficiency of the planar inverted F-antenna is reduced due to reflective loss of an input terminal, and since resonance characteristics is appeared at the length of a quarter-wavelength, the length of the planar inverted F-antenna must be increased.

Moreover, since the ceramic chip antenna employed in the wireless personal digital assistants uses high dielectric material, the radiation efficiency of the ceramic chip antenna is decreased.

SUMMARY OF THE INVENTION

Therefore, the present invention has been made in view of the above and/or other problems, and it is a first object of the present invention to provide an internal antenna for wireless communication using handsets, wireless personal digital assistants, portable communication terminals, or the like.

It is a second object of the present invention to provide a broad bandwidth, high efficiency, and very small-sized internal antenna.

It is a third object of the present invention to provide an internal antenna of a wireless communication terminal capable of being employed in a dual-band wireless communication system having two wireless communication bandwidths or three communication wireless bandwidths.

It is a fourth object of the present invention to provide a monopole antenna having two folded radiation planes and reactance with respect to the folded radiation planes.

In accordance with the present invention, the above and other aspects can be accomplished by the provision of an internal antenna of a wireless communication terminal including a first folded radiation plane having an end to which an input port is connected, a second folded radiation plane having an end to which a shorting pin is connected, a transmission line for connecting the first radiation plane to the second radiation plane, and a junction branched from the transmission line.

In accordance with the present invention, the above and other aspects can be accomplished by the provision of an internal antenna of a wireless communication terminal including a first folded radiation plane having an end to which an input port is connected, a second folded radiation plane having an end to which a shorting pin is connected, a transmission line for connecting the first radiation plane to the second radiation plane, junctions branched into two from the transmission line, and a stub having opened ends and connected to the ends of the junction.

In accordance with the present invention, the above and other aspects can be accomplished by the provision of an internal antenna of a wireless communication terminal including a folded monopole antenna having two folded radiation planes having a quarter wavelength, and reactances loaded to predetermined positions of the two radiation planes.

According to the antenna of the present invention, since a space for installing a small sized folded monopole antenna is minimized and the antenna has no direction, an internal antenna capable of detecting signals transmitted in any direction can be provided.

BRIEF DESCRIPTION OF THE DRAWINGS

These and/or other aspects and advantages of the present invention will become apparent and more readily appreciated from the following description of the embodiments, taken in conjunction with the accompanying drawings, in which.

DESCRIPTION OF THE PREFERRED EMBODIMENTS

Hereinafter, the preferred embodiments of an internal antenna of a wireless communication terminal according to the present invention will be described in detail with reference to the accompanying drawings.

Embodiment 1

Figure 1:
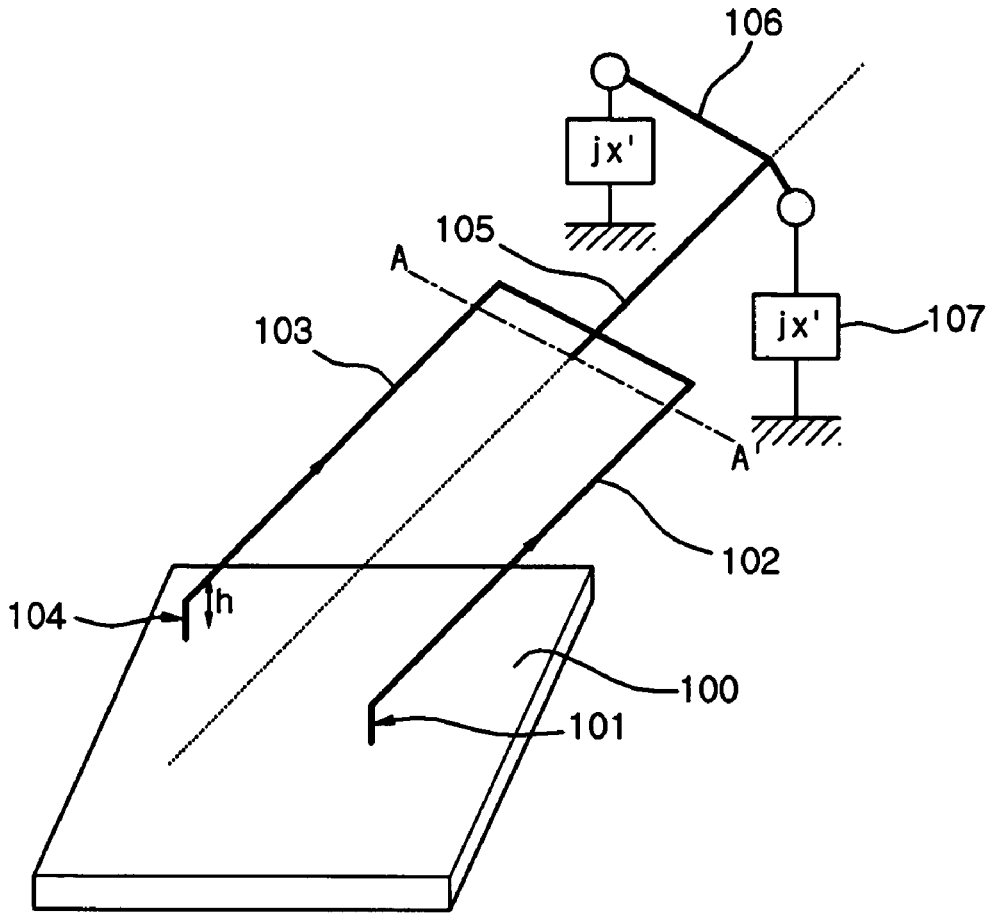
FIG. 1 is a view illustrating the structure of a folded monopole antenna as an internal antenna of a wireless communication terminal according to a first preferred embodiment of the present invention.
Figure 2:
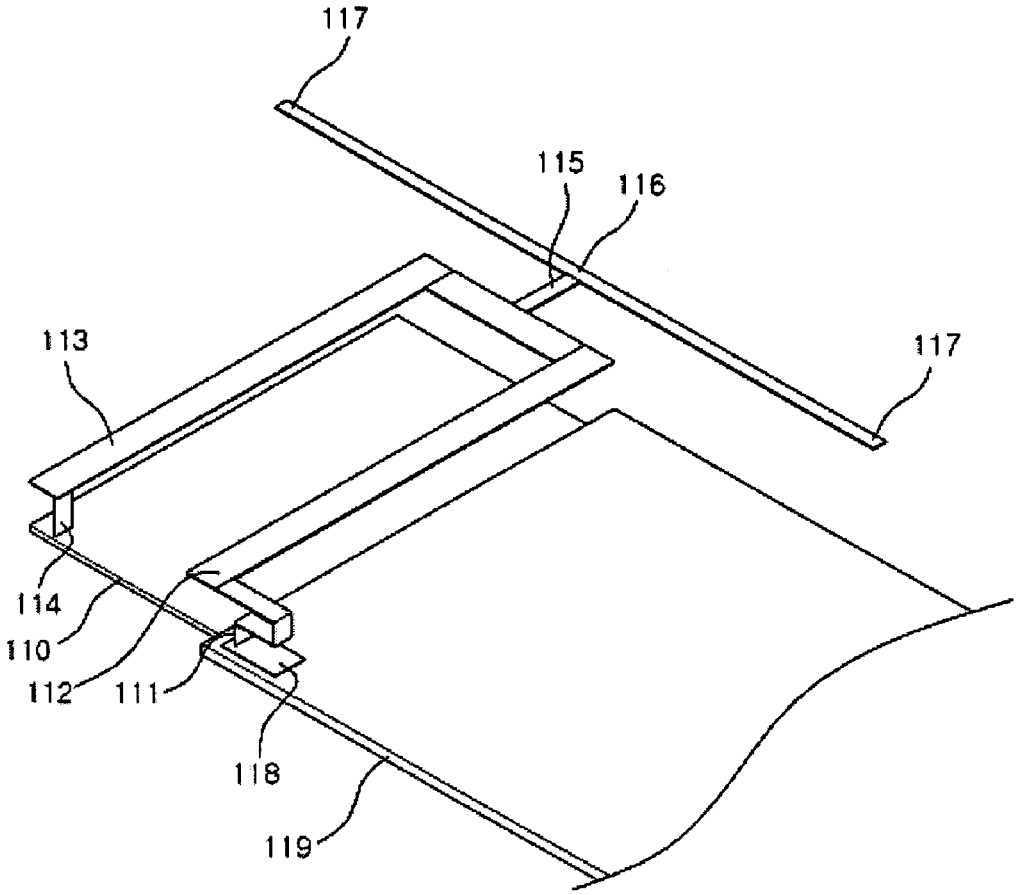
FIG. 2 is a perspective view illustrating an example that the folded monopole antenna in FIG. 1 is employed as a base antenna in the wireless communication terminal.

FIG. 1 is a view illustrating the structure of a folded monopole antenna as an internal antenna of a wireless communication terminal according to a first preferred embodiment of the present invention, and FIG. 2 is a perspective view illustrating an example that the folded monopole antenna in FIG. 1 is employed as a base antenna in the wireless communication terminal.

As shown in FIG. 1, the folded monopole antenna according to the first preferred embodiment of the present invention includes radiation planes 102 and 103 in which two quarter-wavelength antennas are folded, a transmission line 105 connected to the two radiation planes 102 and 103 in the outward direction, a junction 106 branched from the transmission line 105, and a reactance 107 loaded to ends of the junction 106.

Moreover, the folded monopole antenna includes a finite ground 100 parallel to the radiation planes 102 and 103 or an antenna body, and the distance between the finite ground 100 and the radiation planes 102 and 103 or the antenna is equal to the height h of a shorting pin 104.

A signal applied to an input port 101 of the finite ground 100 forms the same direction as the direction of the radiation planes 102 and 103, and is radiated from the radiation planes 102 and 103 radiate the signal.

In the two radiation planes 102 and 103, two quarter-wavelength antennas are folded about a boundary plane or a boundary line B-B'.

Moreover, when a reactance jx' 107 is applied to the respective radiation planes 102 and 103 from a position A-A' of the two radiation planes 102 and 103, the length L of the radiation planes 102 and 103 is shorter than actual quarter wavelength.

The radiation planes 102 and 103 may be parallel to the finite ground 100, may be folded toward a ground in the bottom of the antenna, or in the opposite direction. Here, the antenna may be folded in any direction according to spaces provided in the communication terminal. In order to minimize the contact between the antenna and inner parts of the communication terminal, preferably, the antenna may be folded toward the ground.

As such, the two radiation planes 102 and 103 are symmetrical about the boundary plane or the boundary line B-B', and the junction 106 is formed in the normal direction with respect to the transmission line 105 connected to the boundary line B-B'. The reactance 107 loaded to the ends of the junction 106 may be implemented by a lumped element or a distributed element.

Actually, in order to optimize the characteristics of the antenna, although the two radiation planes 102 and 103 are symmetrical about the boundary plane or the boundary lie B-B' of the two radiation planes 102 and 103, the two antenna must not be symmetrical.

Moreover, the reactance 107 loaded to the junction 106 or the width or the length of the radiation planes 102 and 103 of the antenna and the distance between the two radiation planes 102 and 103 are adjusted to increase the bandwidth. The radiation planes 102 and 103 are lines having a rectangular and circular cross-section.

The two reactance 107 formed at the connecting line 105, the junction 106, and the ends of the junction 106 are located out of the folded radiation planes 102 and 103, and the loaded reactance 107 may be implemented by the stub having an opened ends as the lumped element and the distributed element.

The reactance 107 will be described in connection with a folded monopole antenna using the stub having the opened ends with reference to FIG. 1.

Refer to FIG. 2, an input port is formed in a single radiation plane 112 by a feeding pad of a substrate and a signal is excited to the radiation plane 112. The other radiation plane 113 is shorted to the finite ground at an end edge using a shorting pin 114.

The two radiation planes 112 and 113 are connected to a junction 116 by a transmission line 115 for connecting the two radiation planes 112 and 113, and the junction 116 is connected to the stub 117 having the opened ends.

Each of lines consisting the stub 117 may have a predetermined length and a predetermined angle and may include stubs having opened ends. Moreover, in order to reduce the size, the stub 117 may be folded toward the ground surface or in other direction. The stub 117 may be folded one or more times Thus, length and width of the loaded stub 116, width and length of the antenna radiation planes, and the distance between the two radiation planes are adjusted to increase the bandwidth, thereby enhancing efficiency of the antenna. Therefore, a broad-bandwidth-and-high-efficiency internal antenna can be implemented.

The input port 111 of the antenna is connected to a feeding pad 118 installed in a substrate of a handset, a personal digital assistant, or the like.

The antenna may have no a finite ground formed at the bottom thereof, or may have the finite ground formed at the bottom thereof. If there is the finite ground 110, the finite ground may include whole or some area of the antenna. Moreover, the finite ground 110 may have a partially opened groove or slot.

The antenna as described above is implemented by air or printed circuit board in which line patterns and slots are formed and electrodes with a predetermined thickness provided in a ceramic substrate. Moreover, the antenna may be made of silver, gold, copper and other electric conductive materials in which the line patterns can be formed by vapor-deposition, or copper plate in which the line patterns can be formed.

The antenna has a slim structure having the line patterns and the air slots such that the antenna can be easily installed in the handset, the wireless personal digital assistant, or the like. Moreover, the antenna according to the first preferred embodiment of the present invention may be employed in a wireless communication system having two or three communication bandwidths.

Embodiment 2

Figure 3:
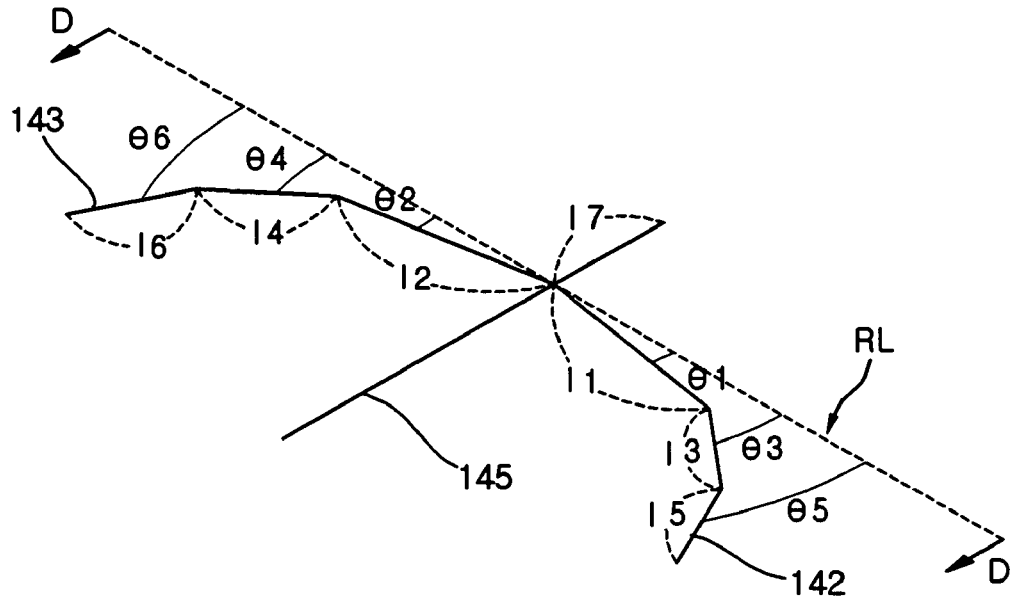
FIG. 3 is a view illustrating the structure of a folded monopole antenna as an internal antenna of a wireless communication terminal according to a second preferred embodiment of the present invention.
Figure 4:
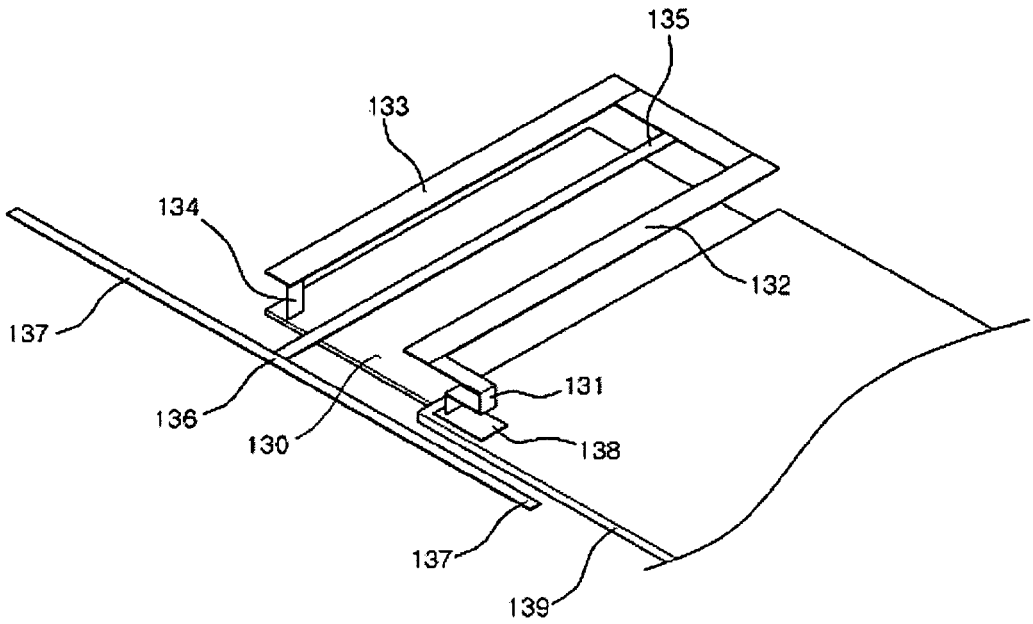
FIG. 4 is a perspective view illustrating an example that the folded monopole antenna in FIG. 3 is employed as a base antenna in the wireless communication terminal.

FIGS. 3 and 4 are schematic views illustrating the structure of a folded monopole antenna as an internal antenna of a wireless communication terminal according to a second preferred embodiment of the present invention.

As shown in FIG. 3, the folded monopole antenna according to the second preferred embodiment of the present invention includes radiation planes 122 and 123 in which two quarter-wavelength antennas are folded, a transmission line 125 connected to the two radiation planes 122 and 123 in the inward direction, a junction 126 connected to an end of the transmission line 125 in the normal direction, and a reactance 127 loaded to ends of the junction 106.

The length reactance 127 is longer than those of the radiation planes 122 and 123, and the length of the junction 126 is longer than the distance between the radiation planes 122 and 123.

The reactance 127 is located inside the folded radiation planes 122 and 123, and may be implemented by a stub having an opened end as the lumped element and the distributed element.

A monopole antenna in which the reactance 127 is implemented by the stub having opened end is depicted in FIG. 4.

As shown in FIG. 4, an end of one 132 of two radiation planes 132 and 133 is connected to an input port 131 connected to a feeding pad 138 of a substrate 139, and the other end of the radiation plane 133 is shorted to a ground 130 via a shorting pin 134.

The transmission line 135 for connecting the radiation planes 132 and 133 extends between the two radiation planes 132 and 133 inwardly, and a junction 136 is formed in the end of the transmission line 135.

The junction 136 forms a stub 137 having an opened end, and each of lines of the stub 137 may have a predetermined length and a predetermined angle and may include stubs having opened ends.

Moreover, in order to reduce the size, the stub 137 may be folded toward the ground surface or in other direction. The stub 137 may be folded to a space not to interfere inner parts of the wireless communication terminal.

Since operation of the folded monopole antenna according to the second preferred embodiment of the present invention is identical to that of the folded monopole antenna according to the first preferred embodiment of the present invention, the operation of the folded monopole antenna according to the second preferred embodiment of the present invention is omitted.

Embodiment 3

Figure 5:
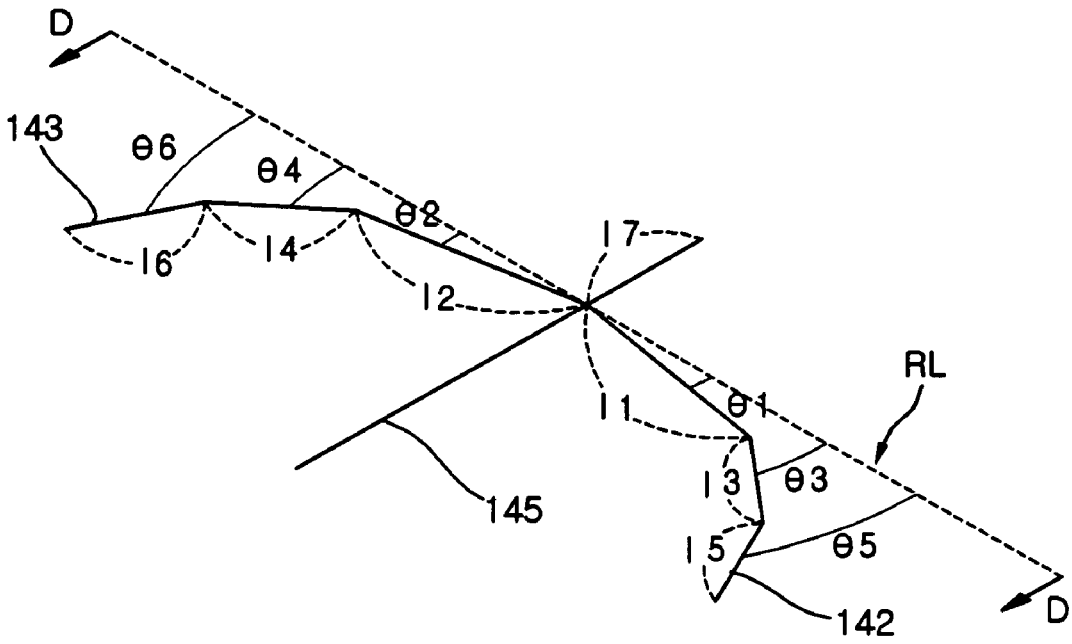
FIG. 5 is a view illustrating the configuration of an opened stub of a folded monopole antenna having of a wireless communication terminal according to a third preferred embodiment of the present invention.
Figure 6:
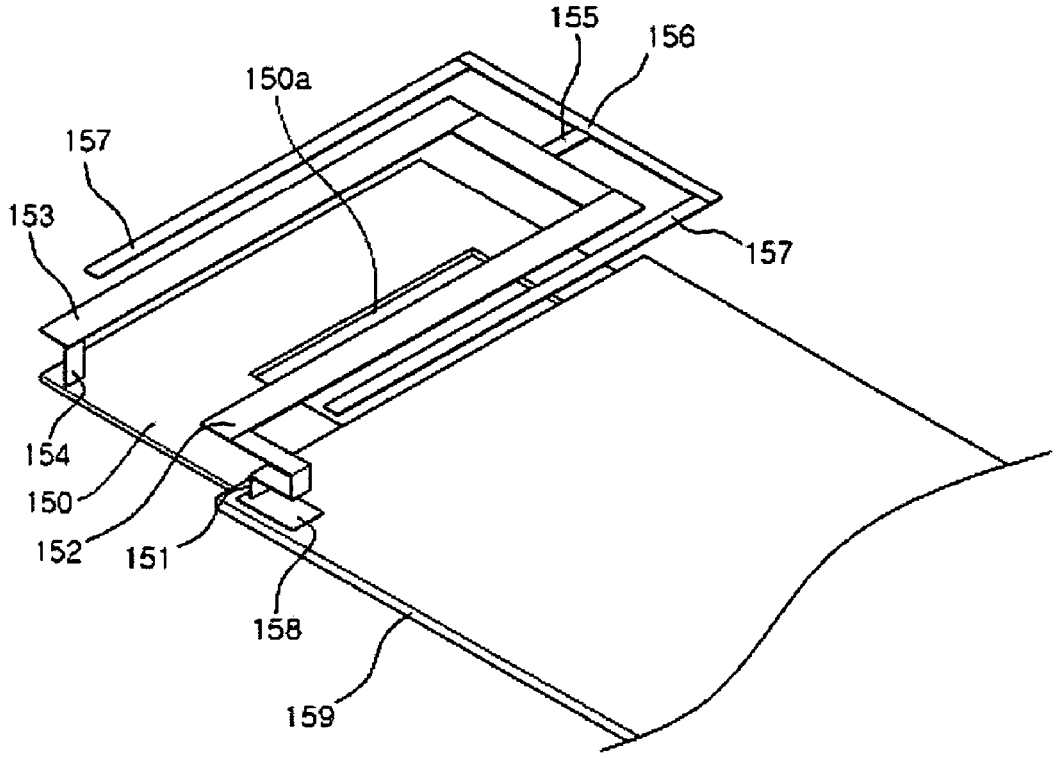
FIG. 6 is a perspective view illustrating a folded monopole antenna employing the stub in FIG. 5.

FIG. 5 is a view illustrating the configuration of an opened stub of a folded monopole antenna of a wireless communication terminal according to a third preferred embodiment of the present invention, and FIG. 6 is a perspective view illustrating a folded monopole antenna employing a modified stub in FIG. 5.

As shown in FIG. 5, stubs 142 and 143 have a predetermined length and a predetermined angle. In other words, the stubs 142 and 143 may be folded multiple times and extend within the range of −90 degrees to +90 degrees, and angles Θ1~Θ6 of respective stub lines may be identical or not. Moreover, respective stub lines have predetermined lengths l1-l6 within a quarter wavelength.

The stub 142 is folded in a predetermined direction, and respective stub lines are symmetrically folded at least once. Here, the respect lines of the stub 142 may be parallel to each other and are formed inwardly or outwardly with respect to a reference line RL. Moreover, in order to reduce the size of the antenna, the respective lines of the stub 142 may be folded toward the ground surface. The stub 142 may be branched into plural stubs and connected to the transmission line 145.

The monopole antenna employing the stub 142 will be described with reference to FIG. 6.

As shown in FIG. 6, the monopole antenna includes radiation planes 152 and 153, a junction 156 placed outside the radiation planes 152 and 153 and connected to the radiation planes 152 and 153 by a connection line 155, and stubs 157 having opened ends and connected to ends of the junction 156. The stubs 157 are bent from the ends of the junction 156 in a predetermined direction to make an L-shape. Thus, the monopole antenna has a T-shape.

In addition, a shorting pin 154 is connected to a finite ground 150, and the finite ground 150 is connected to a substrate 159 to form an opened hole 150*a*.

Embodiment 4

Figure 7:
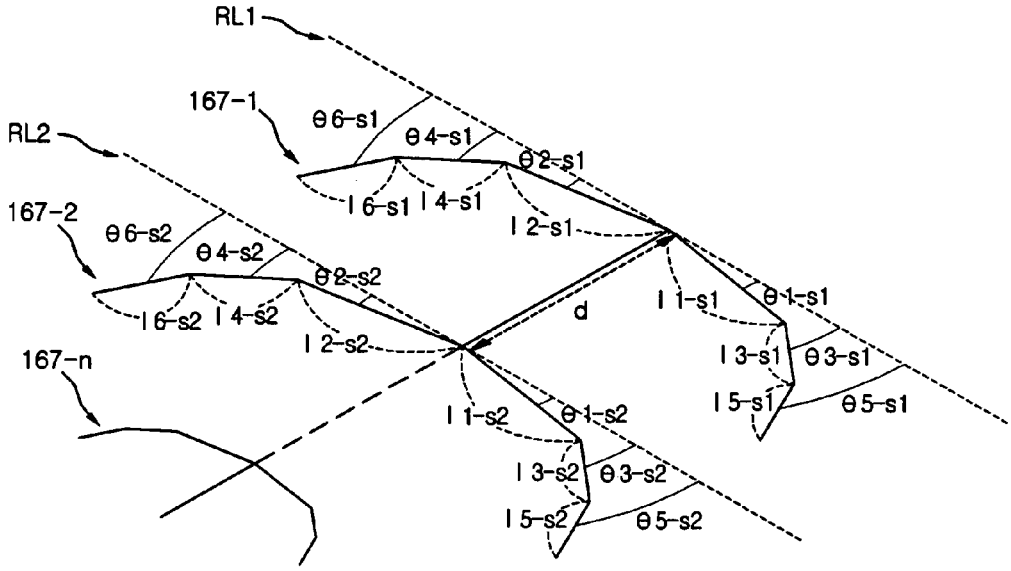
FIG. 7 is a view illustrating a folded monopole antenna employing the stub according to a fourth preferred embodiment of the present invention.
Figure 8:
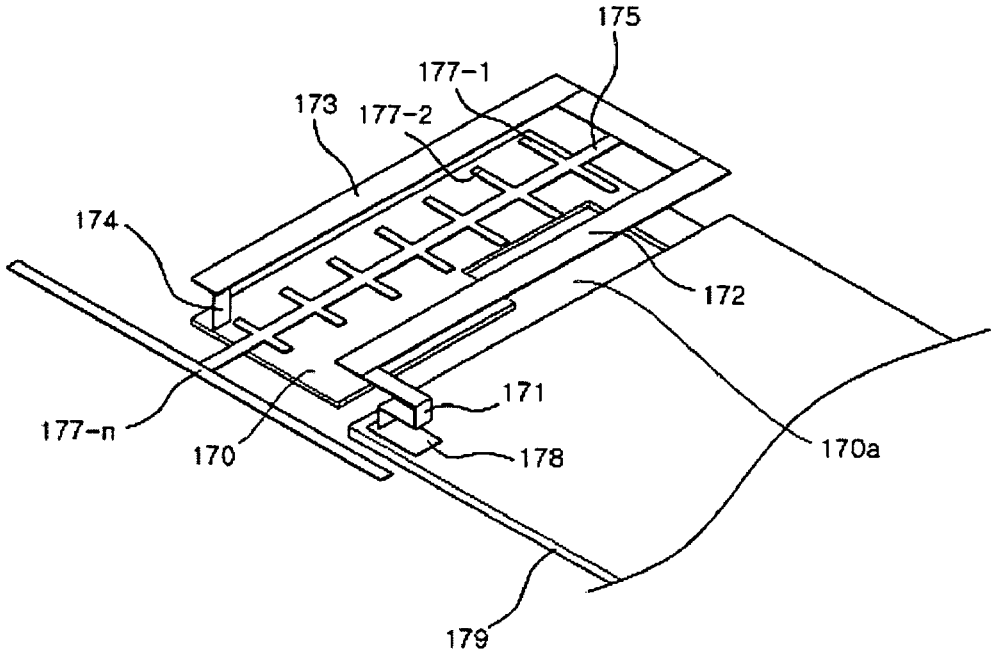
FIG. 8 is a perspective view illustrating a folded monopole antenna employing the stub in FIG. 7.

FIG. 7 is a view illustrating a folded monopole antenna employing the stub according to a fourth preferred embodiment of the present invention, and FIG. 8 is a perspective view illustrating a folded monopole antenna employing the stub in FIG. 7.

As shown in FIG. 7, several stubs 167-1, 167-2, . . . , and 167-*n* having opened ends are arranged at a predetermined distance d. Here, the predetermined distance d between the stubs 167-1, 167-2, . . . , and 167-*n* may be uniform or not. The predetermined distance d between only specific stubs positioned at specific places may be uniform.

Respective lines of the respective stubs 167-1, 167-2, . . . , and 167-*n* are symmetrically folded in a predetermined direction RL several times, lengths l1-2*n*~l6-*sn* and angles Θ1-*sn*~Θ6-*sn* of the respective stub lines are different to each other within a quarter wavelength and within the range of −90 degrees to +90 degrees. Here, length of a stub line may be 0 (zero).

The respective stubs 167-1, 167-2, . . . , and 167-*n* and the respective lines thereof are parallel to each other or certain one of them may be not parallel to the others. Moreover, the respective lines of the respective stubs 167-1, 167-2, . . . , and 167-*n* may be bent toward the ground in order to reduce the size of the antenna.

The structure of a monopole antenna, manufactured using the stubs having the configuration as described above, is depicted in FIG. 8.

As shown in FIG. 8, an input port 171 is connected to a radiation plane 172 by a feeding pad 178 of a substrate 179, and a finite ground 170 is connected to a shorting pin 174 of a radiation plane 173. A plurality of stubs 177-1~177-*n* are connected to the two radiation planes 172 and 173 by a transmission line 175 positioned between the radiation planes 172 and 173, have a predetermined length and a predetermined width, and are arranged at regular intervals. The finite ground has an opened hole 170*a*.

The two radiation planes 172 and 173 are symmetrically bent, and the plural stubs 177-1~177-*n* are connected to the radiation planes 172 and 173 by the transmission line 175 positioned between the radiation planes 172 and 173 at a predetermined interval.

The length of the stubs 177-1~177-*n* have a predetermined value and may be 0 (zero).

Lengths of the lines of the stubs 177-1~177-*n* are different from to each other, and are decreased step by step such that a first stub line has the longest and a next stub line has a length shorter than the length of the first stub. Moreover, a last stub line may have a length different from the lengths of other stub lines.

In addition, the last stub 177*n* may be not positioned in a space between the radiation planes 172 and 173.

Figure 9:
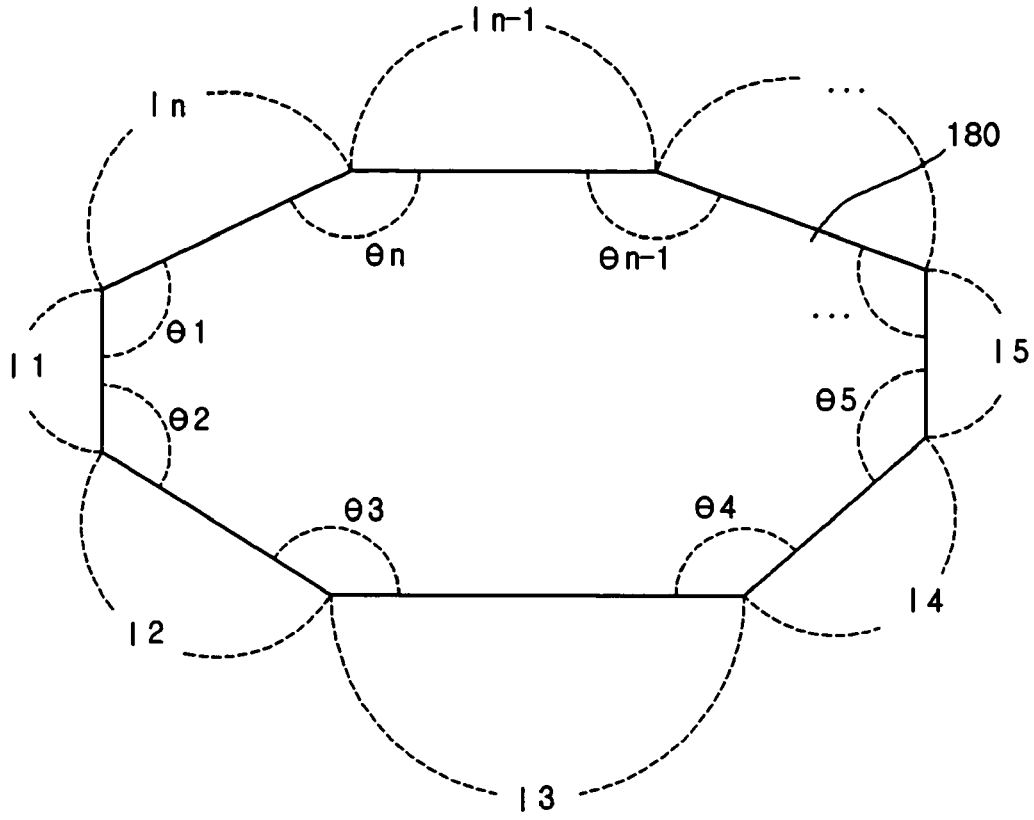
FIG. 9 is a view illustrating the configuration of a finite ground being present at the bottom of an antenna according to the preferred embodiments.
Figure 10:
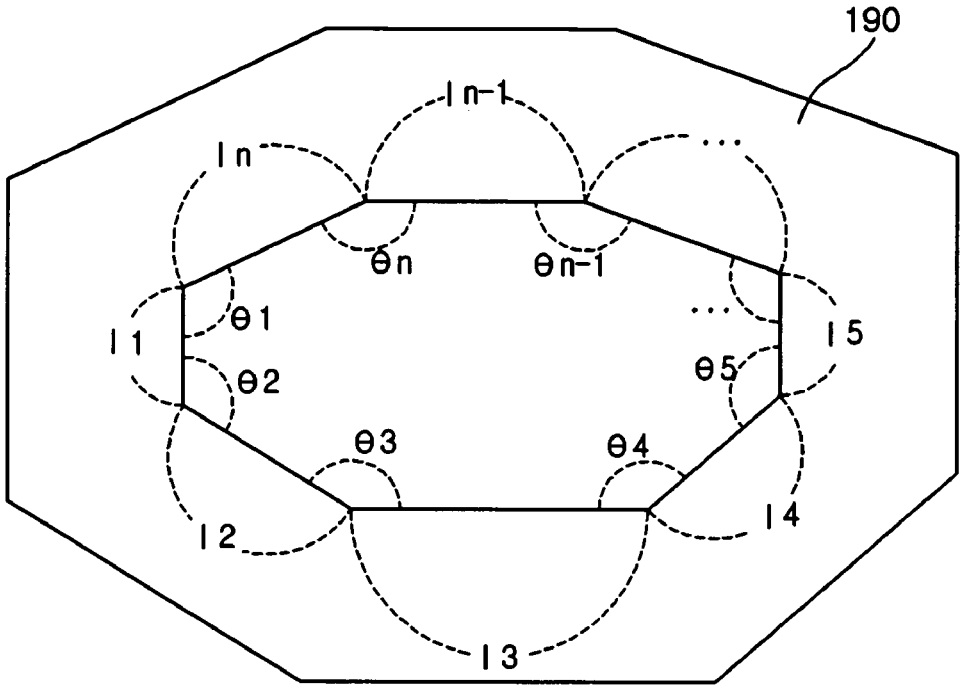
FIG. 10 is a view illustrating the configuration of other finite ground being present at the bottom of an antenna according to the preferred embodiments.

Meanwhile, FIGS. 9 and 10 are views illustrating the configuration of a finite ground being present at the bottom of an antenna according to the preferred embodiments. As shown in FIG. 9, the ground 180 positioned in the bottom of the antenna has a polygonal shape. In other words, the ground in the bottom of the antenna has an n-polygonal shape in which the lengths l1~ln are shorter than a quarter wavelength. Angles at corners of the ground range 1 degree to n degrees within the range of −90 degrees to +90 degrees.

Moreover, the ground in the bottom of the antenna, as shown in FIG. 10, has a polygonal shaped air slot.

FIG. 10 shows configuration of slot formed in the polygonal ground 190 in the bottom of the antenna. The slot has a n-polygonal shape. The slot may be formed in the ground, and a corner of the ground may be opened.

According to the antenna of the present invention, since a space for installing a small sized folded monopole antenna is minimized and the antenna has no direction, an internal antenna capable of detecting signals transmitted in any direction can be provided.

Moreover, based on widths and lengths of radiation planes, distance between two radiation planes, and width and length of a loaded stub having opened ends, broad-bandwidth-and-high-efficiency antenna can be designed, and an internal antenna for wireless communication suit to small portable communication terminals can be provided.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An internal antenna of a wireless communication terminal comprising:

a first folded radiation plane having an end to which an input port is connected;

a second folded radiation plane having an end to which a shorting pin is connected;

a transmission line for connecting the first folded radiation plane to the second folded radiation plane; and a junction branched from the transmission line, wherein reactances are loaded to both ends of the junction.

2. The internal antenna of a wireless communication terminal as claimed in claim 1, wherein the first and second folded radiation planes have a quarter wavelength.

3. The internal antenna of a wireless communication terminal as claimed in claim 1, wherein the transmission line and the junction are positioned outside the first and second folded radiation planes.

4. The internal antenna of a wireless communication terminal as claimed in claim 1, wherein the transmission line and the junction are positioned inside the first and second folded radiation planes.

5. The internal antenna of a wireless communication terminal as claimed in claim 1, wherein each of the reactances includes a stub having an opened end.

6. The internal antenna of a wireless communication terminal as claimed in claim 1, wherein the shorting pin is connected to a finite ground.

7. The internal antenna of a wireless communication terminal as claimed in claim 1, wherein the input port is connected to a feeding pad.

8. An internal antenna of a wireless communication terminal comprising:

a first folded radiation plane having an end to which an input port is connected;

a second folded radiation plane having an end to which a shorting pin is connected;

a transmission line for connecting the first folded radiation plane to the second folded radiation plane;

junctions branched into two from the transmission line; and a stub having opened ends and connected to both ends of the junction.

9. The internal antenna of a wireless communication terminal as claimed in claim 8, wherein the stub comprises a plurality of stubs.

10. The internal antenna of a wireless communication terminal as claimed in claim 9, wherein the plurality of stubs comprise lines folded at least one time.

11. The internal antenna of a wireless communication terminal as claimed in claim 10, wherein each of the lines of the stubs has a length shorter than a quarter wavelength.

12. An internal antenna of a wireless communication terminal comprising:

a first folded radiation plane coupled to an input port;

a second folded radiation plane coupled to a shorting pin;

a transmission line coupling the first folded radiation plane to the second folded radiation plane; and a junction branched from the transmission line having reactances loaded to the junction.

13. The internal antenna of a wireless communication terminal as claimed in claim 12, wherein each of the first and second folded radiation planes have a quarter wavelength.

14. The internal antenna of a wireless communication terminal as claimed in claim 12, wherein the transmission line and the junction are provided outside the first and second folded radiation planes.

15. The internal antenna of a wireless communication terminal as claimed in claim 12, wherein the transmission line and the junction are provided inside the first and second folded radiation planes.

16. The internal antenna of a wireless communication terminal as claimed in claim 12, wherein each reactance includes a stub having an opened end.

17. The internal antenna of a wireless communication terminal as claimed in claim 12, wherein the shorting pin is coupled to a finite ground.

18. The internal antenna of a wireless communication terminal as claimed in claim 12, wherein the input port is coupled to a feeding pad.

19. The internal antenna of a wireless communication terminal is claimed in claim 12, wherein the reactances are loaded to ends of the junction.

* * * * *